United States Patent [19]

Kelly et al.

[11] Patent Number: 4,774,489

[45] Date of Patent: Sep. 27, 1988

[54] TEMPERATURE RESPONSIVE ELECTRICAL SWITCH DEVICE

[75] Inventors: Ronald W. Kelly; Kennett R. Fuller, both of Morisson, Ill.

[73] Assignee: General Electric Company, Fort Wayne, Ind.

[21] Appl. No.: 108,209

[22] Filed: Oct. 14, 1987

[51] Int. Cl.[4] ..... H01H 37/36; H01H 37/74

[52] U.S. Cl. ..... 337/314; 337/115; 337/312

[58] Field of Search ..... 337/312, 314, 311, 317, 337/318, 319, 320, 321, 323, 115, 117, 118, 119; 200/83 WM

[56] References Cited

U.S. PATENT DOCUMENTS

| | | | |
|---|---|---|---|
| 3,648,214 | 3/1972 | Slonneger | 337/311 |
| 4,192,980 | 3/1980 | Kothe | 337/318 |
| 4,617,432 | 10/1986 | Hanssen et al. | 200/83 WM |
| 4,696,204 | 9/1987 | Buckshaw et al. | 200/83 WM |

*Primary Examiner*—H. Broome

*Attorney, Agent, or Firm*—Ralph E. Krisher, Jr.

[57] ABSTRACT

A temperature responsive electrical switch device has means operable generally for switching between a pair of switching means, and temperature responsive means is operable generally at a set-point temperature for effecting the operation of the switching means. Means is linearly movable in response to an applied force exerted thereon and arranged in camming engagement with an associated part of the temperature responsive means for setting the set-point temperature.

15 Claims, 1 Drawing Sheet

TEMPERATURE RESPONSIVE ELECTRICAL SWITCH DEVICE

FIELD OF THE INVENTION

This invention relates in general to temperature responsive electrical switch devices and in particular to such devices for utilization in refigeration systems.

BACKGROUND OF THE INVENTION

In some refrigeration systems, such as may be employed with a room air conditioner or a refrigerator or the like for instance, various types of past condition responsive electrical switch devices were utilized to control the operation of such refrigeration systems. These past condition reponsive electrical switch devices generally included switching means for energizing and deenergizing various electrical components of the refrigeration system, and such switching means were actuated by various types of operators generally in response to temperature sensing means associated therewith for sensing the temperature of a given space conditioned by the refrigeration system. Of course, these temperature responsive electrical switch devices were adjustable so as to operate at a selected set point temperature for the given space as sensed by the temperature sensing means of the temperature responsive electrical switch device. In other words, a rotatable cam was adjustably associated in camming engagement with an associated part of the temperature sensing means and manually rotated through a temperature range to a preselected or set point temperature, and such manual rotational movement of the rotatable cam, in effect, adjusted or biased the associated part of the temperature sensing means so that the temperature sensing means actuated the switching means when the set point temperature of the given space cooled by the refigeration system was sensed by the temperature sensing means. Upon the actuation of the switching means at the set point temperature sensed by the temperature sensing means, the switching means effected the energization or deenergization of the aforementioned electrical components of the refigeration system so as to control the conditioning or cooling of the given space. One such temperature responsive electrical switch device utilizing a rotatable cam to select the set point temperature therefor, as discussed above, is disclosed in U.S. Pat. No. 3,648,214 issued Mar. 7, 1972 to John L. Slonneger, and this patent is incorporated by reference herein.

In at least one of the aforementioned past temperature responsive electrical switch devices, a rotatable cam utilized therein to select the set point temperature contained a plurality of different parts which were assembled together through an opening in a cover plate or casing part of the temperature responsive electrical switch device, and it is believed that at least one disadvantageous or undesirable feature of this past temperature responsive electrical switch device was that it was time consuming to effect the assembling together of so many different parts. For instance, in the aforementioned assembly of the past rotatable cam, a steel shaft thereof was nested in a hydraulic press with a knurled end of the steel shaft exposed or facing upwardly. An annular steel washer was placed about the knurled end of the shaft and rested on a shoulder thereof. A torque washer, such as as annular wavy spring or the like for instance, was then disposed on top of the steel washer, and one side of a cover plate for the temperature responsive electrical switch device about an opening through the cover plate was disposed so as to be engaged on top of the torque washer. Thereafter, an annular zinc cam was pressed onto the knurled end of the shaft with a flange of the zinc cam engaging the opposite side of the cover plate. To complete this past assembly, the knurled end of the shaft was staked or swagged over into displacement preventing engagement with the zinc cam.

SUMMARY OF THE INVENTION

Among the several objects of the present invention may be noted the provision of an improved temperature responsive electrical switch device which overcomes the above discussed disadvantageous or undesirable features, as well as others, of the prior art; the provision of such improved temperature responsive electrical switch device in which a linearally movable cam means is actuated in response to a manually applied force exerted thereon for selecting or setting a set point temperature within a temperature range in which the device is operable; the provision of such improved temperature responsive electrical switch device in which the magnitude of the manually applied force exerted on the linearally movable cam to select the set point temperature is of a relatively low value; the provision of such improved temperature responsive electrical switch device having switching means operable upon the occurance of the set point temperature from one switching mode to another switching mode and with the linearly movable cam having a preselected position for obviating operation of the switching means; and the provision of such improved temperature responsive electrical switch device in which the components thereof are simple in design, economically manufactured and easily assembled. These as well as other objects and advantageous features of the present invention will be in part apparent and in part pointed out hereinafter.

In general, a temperature responsive electrical switch device in one form of the invention has switching means operable generally for actuation between a pair of switching modes, and switch actuating means is operable generally for effecting the actuation of the switching means from one of the switching modes to another of the switching modes thereof. Temperature responsive means is operable for effecting the operation of the switch actuating means. Means to actuate the switching means generally at a selected set point temperature for the device linearly movable in response to a manually applied force exerted thereon is arranged in camming engagement with an associated part of the temperature responsive means for setting the selected set point temperature, the setting means including cam means for camming engagement with a part of the switch actuating means to effect the actuation of the switching means independently of the temperature responsive means.

Also in general and in one form of the invention, a temperature responsive electric switch device has a housing, a cover associated with the housing and having a slot therein, and guide means associated with the cover for defining a generally linear channel communicating with the slot. Switching means is disposed at least in part within the housing for actuation between a plurality of switching modes, and actuating means is operable generally for effecting the actuation of the switching means from one of the switching modes to another of the switching modes thereof. Temperature responsive means is provided for effecting the operation of the actuating means to actuate the switching means at a selected set point temperature for the device, and the temperature responsive means includes cam follower means for extending in part through the slot into the linear channel. Cam means is linearly movable in the linear channel in response to a manually applied force exerted on the cam means, and the cam means is arranged in camming engagement with the cam follower means for setting the selected set point temperature.

The exemplifications set out herein illustrate the preferred embodiment of the invention in one form thereof, and such exemplifications are not to be construed as limiting either the scope of the disclosure or the scope of the invention in any manner.

DETAILED DESCRIPTION OF THE PREFERRED EMBODIMENT

Figure 1:
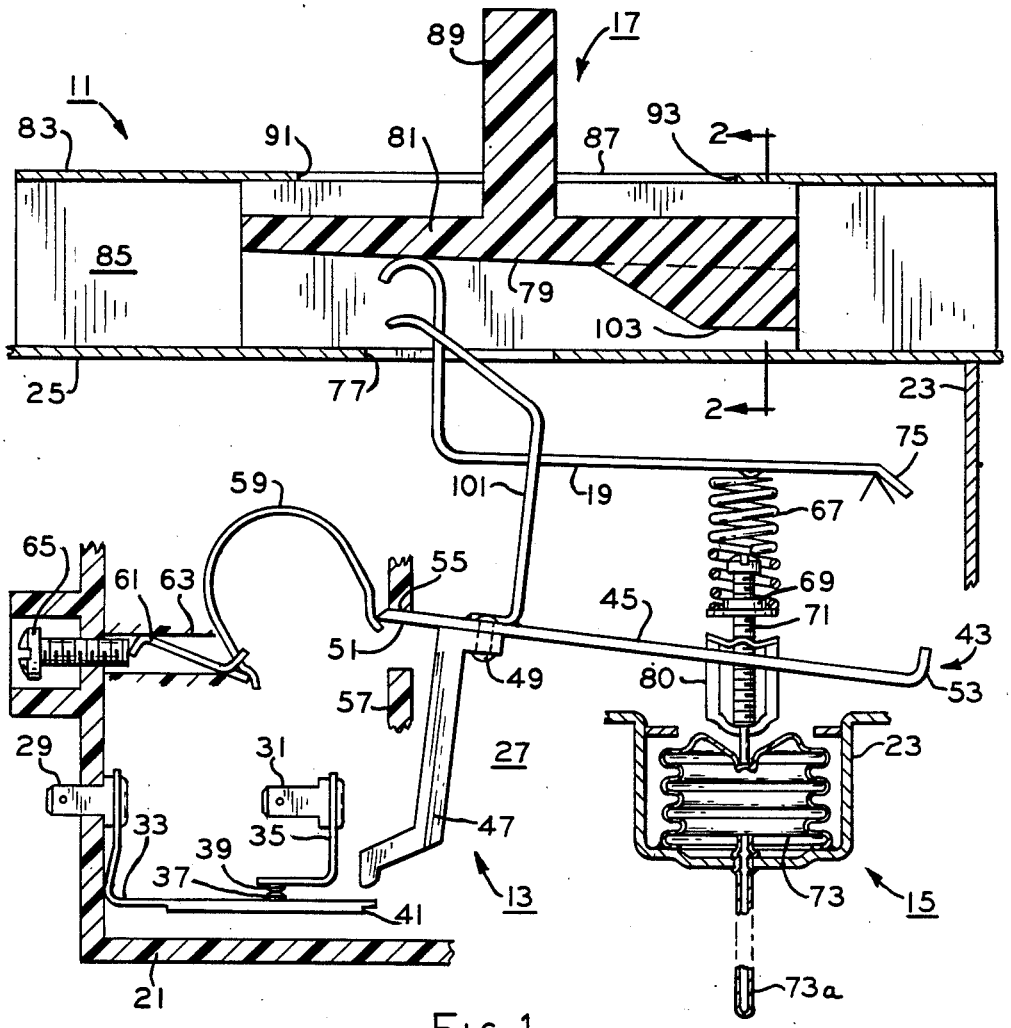
FIG. 1 is a side view, partially in cross-section, schematically illustrating a temperature responsive electrical switch device in one form of the invention.

Referring now to the drawings in general, there is illustrated in one form of the invention a condition responsive device, such as a temperature responsive electrical switch device 11, which is commonly referred to as a cold control (FIG. 1). Device 11 has means, such as for instance switch or switching means 13 or the like, operable generally for switching between a pair of switching modes so as to control the energization or deenergization of various electrical components of a refrigeration system (not shown) for a given space to be conditioned or cooled thereby. A temperature responsive means or temperature sensing means 15 is operable generally at a selected set point temperature for effecting the operation of switching means 13 from one of the switching modes to the other of the switching modes thereof. Means such as for instance a linearly or reciprocally movable cam cam means 17 or the like, is linearly actuated in response to a manually applied force exerted thereon and is arranged in camming engagement with an associated part 19 of temperature responsive means 15 for setting the set point temperature (FIGS. 1 and 2).

Figure 2:
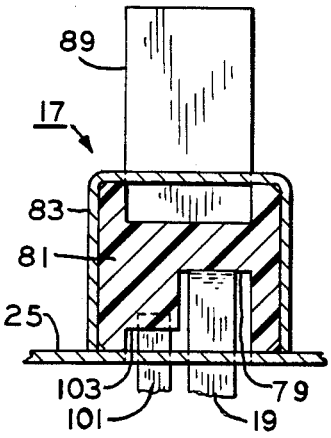
FIG. 2 is a sectional view taken along line 2—2 in FIG. 1.

More particularly and with specific reference to FIGS. 1 and 2, device 11 has a housing or casing 21 which is at least in part generally similar to that disclosed in greater detail in the aforementioned U.S. Pat. No. 3,648,214. Housing 21 may be suitably formed of a molded resin, such as for instance a phenolic thermosetting plastic or the like, and a somewhat U-shaped frame 23 constructed of any suitable material, such as for instance stainless steel or the like. Housing 21 and frame 23 are securely mounted together in an assembled relation by any suitable means, such as for instance a plurality of posts (not shown). In the conventional manner, frame 23 supports temperature responsive means 15 and a cover or cover plate 25 which may, if desired, include a mounting means (not shown) for securing device 11 onto a supporting panel (not shown) therefor.

Switching means 13 is accomodated or disposed in a chamber 27 of housing 21 and includes a pair of terminals 29, 31 each of which are securely attached or molded into the housing so as to provide stable external connections for associated wiring of the refrigeration system (not shown) and stable supports for a pair of switch elements 33, 35 within housing chamber 27. Switch element 33 may be formed of any suitable material having the desired resilient and electrical conductive characteristics, such as for instance beryllium copper or the like, and one end of the switch element 33 is secured by suitable means, such as soldering or welding or the like for instance, to terminal 29. A pair of laminated contacts 37, 39 each having a convexly curved face preferably formed of silver are secured by suitable means, such as welding or the like, to switch element 33 adjacent a free end or end portion 41 thereof and to switch element 35, and as shown in one of the switching modes of switching means 13 in FIG. 1, switch element 33 resiliently urges its contact 37 toward making engagement with contact 39 on switch element 35.

Means, such as for instance a switch actuator or actuating means 43 or the like, is provided for effecting the actuation or operation of switching means 13 between its switching modes. Switch actuator 43 has a motion transmitting arm or member 45 and a depending switch operating arm 47 secured by a rivet 49 adjacent a leftward end 51 of the motion transmitting arm wherein the motion transmitting arm and the switch operating arm are conjointly movable or pivotable as a unit. Switch operating arm 47 overlays free end 41 of switch element 33 to selectively operate it in response to rotational or pivotable movement of switch actuator 43. A rightward end 53 of motion transmitting arm 45 is provided as a securement and a pivot for such arm, and leftward end 51 of such arm projects through an opening 55 in an interior wall 57 of housing 21. A generally U-shaped or toggle spring 59 is biased between leftward end 51 of motion transmitting arm 45 and an adjustable pivot member 61 positioned in a channel 63 for longitudinal sliding movement within housing 21. A differential adjusting screw 65 is threadedly received in housing 21 so as to be accessable from exteriorly thereof, and such adjusting screw furnishes a linearly movable adjustable support engaged with pivot member 61. Thus threaded adjustment of screw 65 bears against pivot member 61 to adjust the tension of toggle spring 59 and its force exerted on leftward end 51 of motion transmitting arm 45. Motion transmitting arm 45 may be additionally supported for pivotable movement about an engagement with shoulders and slots (not shown) in a manner disclosed in U.S. Pat. No. 3,648,214 and will not be further discussed.

Like that shown in U.S. Pat. No. 3,648,214, temperature responsive means 15 is conventionally provided with a coiled range spring 67 which acts through a nut 69 and an abutment cage or abutment means 80 on a screw 71 to exert a continuous force onto motion transmitting arm 45 thereby tending to rotate or pivot it in a counterclockwise direction about the pivotal rightward end 53 of such arm. This range spring force may be overcome by increasing the force which a bellows 73 of temperature responsive means 15 exerts on screw 71 which tends to lift the screw againt range spring 67. Of course, bellows 73 and its associated capillary tube **73*a* is charged with a temperature sensitive pressure fluid, such as for instance freon gas or other suitable volatile liquid or the like, and such temperature sensitive pressure fluid is responsive to temperature variations in the aforementioned given space to vary the force exerted by the bellows 73 and range spring 67 on motion transmitting arm 45 as is well known and will not be further reviewed other than to note that by varying the compression of the range spring, the sensed temperature level or set point temperature at which device 11** operated may be adjusted.

To effect this adjusting function in device 11, the aforementioned associated part 19, such as for instance a cam follower or the like, of temperature responsive means 15 is urged or biased against against the upper end of range spring 67. One end of cam follower 19 is pivotally mounted at 75 to frame 23, and the other end of the cam follower protrudes through an opening or slot 77 in cover 25 into following engagement with a cam or camming surface 79 provided on a body 81 of cam 17 in facing relation with the exterior side of cover 25. Cam body 81 may be formed of any suitable resin material, such as for instance a thermosetting plastic or the like. The aforementioned linear movement of cam 17 is defined by a linear guide or guide means 83 secured by suitable means, such as welding or the like for instance (not shown), to the exterior side of cover 25 so as to extend over opening 77 therein. Therefore, guide 83 and the exterior side of cover 25 form a linear guide channel 85 which defines the aforementioned linear movement of cam 17 and in which cam body 81 is slidably and guidably received. Another opening or slot 87 is provided in guide 83 through which a finger 89 on cam body 83 extends, and slot 87 has a pair of opposite abutment ends 91, 93 for engagement with the finger to positively limit the movement of cam 17 in opposite linear directions in response to an operator or manually applied force exerted on the finger. Thus, it may be noted that the adjusting or linear movement of cam 17 in guide channel 85 in response to the operator applied force exerted on cam finger 89 drivingly engages cam surface 79 with cam follower 19 pivoting it at 75 thereby to alter or adjust the force exerted by the cam follower on range spring 67. In this manner, cam follower 19 responds to the linear positioning or movement of cam 17 in guide channel 85 into an operator selected position to effect the selection of a set point temperature by altering the compression of range spring 67 between the cam follower and nut 69 on screw 71 associated with bellows 73.

For the purpose of describing the operation of device 11, it will be assumed that the set point temperature has been selected by linearly adjusting the position of cam 17 in guide channel 85 in the manner discussed hereinabove. Assume further that bellows 73 senses a decrease in temperature which decreases the pressure fluid charge in the bellows to effect a desired contraction of the bellows. This, in turn, causes a decrease in the force exerted by bellows 73 against screw 71. Range spring 67 therefore overpowers bellows 73 to the point where, at the selected set point temperature, the clockwise force on leftward end 51 of motion transmitting arm 45 is overcome, and the leftward end of such arm is snapped downwardly from engagement with the upper wall of opening 55 into engagement with the lower wall of opening 55. In response to this snap action operation of motion transmitting arm 45, switch operating arm 47 is driven into engagement with free end 41 of switch element 33 causing it to move from the switching mode or position shown in FIG. 1 to another switching mode or open position disengaging or breaking contact 37 on switch element 33 from contact 39 on switch element 35. Of course, when contacts 37, 39 are disengaged, the electrical components of the refrigeration system (not shown) connected with terminals 29, 31 are deenergized.

When conditions are such that bellows 73 senses an increase in the temperature, the pressure fluid charge in the bellows increases to effect a corresponding expansion of the bellows which increases the force exerted by the bellows against screw 71. This increased force exerted by bellows 73 against screw 71 overcomes range spring 67 and causes the return clockwise pivotal movement of motion transmitting arm 45 with snap action towards its original position in engagement with the upper wall of housing opening 55. Of course, in response to the return clockwise pivotal movement of motion transmitting arm 45, switch operating arm 47 is conjointly returned toward its position shown in FIG. 1 disengaged from free end 41 of switch element 33, and switch element 33 resiliently urges its contact 37 into reengagement with contact 39 on switch element 35. Upon the reengagement of contact 37, 37 as discussed above, the electrical components of the refrigeration system (not shown) connected with terminals 29, 31 are again energized.

If desired, device 11 may also be provided with a construction embodying a manual off feature. In this construction, another or manual off cam follower 101 has one end secured by suitable means, such as riveting or welding for instance, to motion transmitting arm 45, and the other end of the manual off cam follower protrudes through opening 77 in cover 25 into linear guide channel 85 beneath cam 17. In addition to cam surface 79, cam body 81 of cam 17 is also provided with another cam or camming surface 103 facing the exterior side of cover 25 for camming engagement with cam follower 101. When the operator desires to linearly move cam 17 to a preselected or manual off position in guide channel 85, an operator or manually applied force exerted on finger 89 of cam 17 moves the cam leftwardly in the guide channel until the finger is disposed at least adjacent leftward end 91 of slot 87 in linear guide 83. Upon the applied force linear movement of cam 17 toward its manual off position, cam surface 109 is moved into camming engagement with manual off cam follower 101 thereby to pivot motion transmitting arm 45 with snap action in a counterclockwise direction against toggle spring 59. In response to this manual snap action operation of motion transmitting arm 45, switch operating arm 47 is driven into engagement with free end 41 of switch element 33 causing its movement to the open position breaking contact 37 from contact 39 on switch element 35. Thus, it may be noted when cam 17 is in the manual off position, the camming engagement of cam surface 103 with manual off cam follower 101 is effective to maintain the engagement of switch operating arm 47 with free end 41 of switch element 33 so as to break contact 37 on switch element 33 from contact 39 on switch element 35. It may also be noted that the operation of switching means 15 by the linear movement of cam 17 to its manual off position is independent of the operation of temperature responsive means 15. In this manner, when cam 17 is in its manual off position, device 11 is disabled, and the operation of switching means 13 by temperature responsive means 15 is obviated.

From the foregoing, it is apparent that novel temperature responsive electrical switch device 11 has been presented meeting the objects set out herein, as well as others, and it is contemplated that changes as to the precise arrangements, shapes, details and connections of the component parts of such device may be made by those having ordinary skill in the art without departing from the spirit of the invention or the scope thereof as set out in the claims which follow.

What we claim as new and desire to secure by Letters Patent of the United States is:

1. A temperature responsive electrical switch device comprising:

a housing;

a cover associated with said housing and having a slot therein;

a guide associated with said cover exteriorly of said housing and defining with said cover a linear channel communicating with said slot;

cam means linearly movable in said linear channel into selected positions for setting set point temperatures for the device and slidably arranged in guiding engagement with said cover and said guide within said linear channel, said cam means including a cam surface arranged in facing relation with said cover and overlaying said slot at least in part;

switching means in said housing for actuation between a pair of switching modes;

switch actuating means pivotally movable in said housing for effecting the actuation of said switching means from one of the switching modes into the other of the switching modes thereof; and temperature responsive means in said housing and operable generally at a selected set point temperature for the device for effecting the pivotal movement of said switch actuating means to actuate said switching means from the one switching mode into the other switching mode thereof, said temperature responsive means including cam follower means extending through said slot into camming engagement with said cam surface for exerting a force in opposition to the operation of said temperature responsive means in response to the linear movement of said cam means into its selected position setting the set point temperature.

2. The device as set forth in claim 1 wherein said guide includes another slot therein communicating with said linear channel and arranged at least in part generally opposite said first named slot, and said cam means further including means extending through said another slot exteriorly of said guide for receiving a manually applied force to effect the linear movement of said cam means into its position selecting the set point temperature for the device.

3. The device as set forth in claim 1 wherein said cam means further includes another cam surface adjacent said first named cam surface and arranged in facing relation with said cover within said linear channel, and said switch actuating means including another cam follower means extending through said slot into said linear channel for following engagement with said another cam surface, said another cam follower means effecting the pivotal movement of said switch actuating means independently of said temperature responsive means to actuate said switching means from the one switching mode into the other switching mode thereof when said another cam surface is moved into camming engagement with said another cam follower means.

4. The device as set forth in claim 1 wherein said switch actuating means includes toggle spring means for imparting snap action to the pivotal movement of said switch actuating means.

5. A temperature responsive electrical switch device comprising:

a housing;

a cover associated with said housing and having a slot therein;

guide means associated with said cover for defining a generally linear channel communicating with said slot;

switching means disposed at least in part within said housing for actuation between a plurality of switching modes;

actuating means operable generally for effecting the actuation of said switching means from one of the switching modes to another of the switching modes thereof;

temperature responsive means for effecting the operation of said actuating means to actuate said switching means at a selected set point temperature for the device, said temperature responsive means including cam follower means for extending in part through said slot into said linear channel; and cam means linearly movable in said linear channel in response to a manually applied force exerted on said cam means and arranged in camming engagement with said cam follower means for setting the selected set point temperature.

6. The device as set forth in claim 5 wherein said cam means includes a cam surface arranged generally in facing relation with said cover and in the caming engagement with said cam follower means.

7. The device as set forth in claim 5 wherein said actuating means includes another cam follower means extending in part through said slot into said channel for engagement with said cam means, and the linear movement of said cam means into the engagement with said another cam follower means being effective to actuate said switching means from one switching mode to the another switching mode thereof independently of said temperature responsive means.

8. The device as set forth in claim 7 wherein said cam means includes a cam surface arranged generally in facing relation with said casing and disposed to engage said another cam follower means.

9. The device as set forth in claim 5 wherein said cam means includes a plurality of cam surfaces, one of said cam surfaces being disposed in the camming engagement with said cam follower means to set the set point temperature in response to the linear movement of said cam means, and said actuating means including another cam follower means for camming engagement with another of said cam surfaces to effect the operation of said actuating means to actuate said switching means from the one switching mode to the another switching mode thereof independently of said temperature responsive means when said another cam surface is moved into the camming engagement with said another cam follower means in response to the linear movement of said cam means.

10. A temperature responsive electrical switch device comprising:

switch means operable generally for switching between a plurality of switching modes;

actuating means operable generally for effecting the operation of said switch means from one of the switching modes to another of the switching modes thereof;

temperature responsive means for effecting the operation of said actuating means to operate said switch means from the one switching mode to the another switching mode thereof generally at a selected set point temperature for the device; and means movable in response to a manually applied force exerted thereon and engaged with an associated part of said temperature responsive means for setting the selected set point temperature, said setting means including means responsive to the manually applied force movement of said setting means into a preselected position for effecting the operation of said actuating means independently of said temperature responsive means so as to releasably maintain said switch means in the another switching mode thereof.

11. The device as set forth in claim 10, further comprising guide means associated with said setting means for defining the linear movement thereof.

12. The device as set forth in claim 10 wherein said setting means further includes a plurality of cam surfaces, one of said cam surfaces being engaged with said associated part of said temperature rsponsive means so as to set the selected set point temperature in response to the manually applied force movement of said setting means, and said operation effecting means comprising another of said cam surfaces arranged in engagement with a part of said actuating means.

13. The device as set forth in claim 10 wherein said actuating means includes means for imparting snap action to the operation of said switch means between the switching modes thereof.

14. A temperature responsive electrical switch device comprising:

switching means for actuation between a pair of switching modes;

switch actuating means operable generally for effecting the actuation of said switching means from one of the switching modes to the other of the switching modes thereof;

temperature responsive means for effecting the operation of said switch actuating means to actuate said switching means generally at a selected set point temperature for the device; and means linearly movable in responsive to a manually applied force exerted thereon and arranged in camming engagement with an associated part of said temperature responsive means for setting the selected set point temperature, said setting means including cam means for camming engagement with a part of said switch actuating means to effect the actuation of said switching means independently of said temperature responsive means.

15. A temperature responsive electrical switch device comprising:

switching means for actuation between a pair of switching modes;

switch actuating means operable generally for effecting the actuation of said switching means from one of the switching modes to the other of the switching modes thereof;

temperature responsive means for effecting the operation of said switching actuating means to actuate said switching means generally at a selected set point temperature for the device;

means linearly movable in response to a manually applied force exerted thereon and arranged in camming engagement with an associated part of said temperature responsive means for setting the selected set point temperature, said setting means including a plurality of cam surfaces;

said associated part of said temperature responsive means comprising a cam follower arranged in the camming engagement with one of said cam surfaces; and said switch actuating means including cam follower means for camming engagement with another of said cam surfaces to effect the operation of said switch actuating means to actuate said switching means independently of said temperature responsive means when said another cam surface is moved into the camming engagement with said cam follower means.

* * * * *